US009821937B2

(12) United States Patent
Staeben et al.

(10) Patent No.: US 9,821,937 B2
(45) Date of Patent: Nov. 21, 2017

(54) TUBE/BOTTLE TOPS HAVING INTEGRATED CAP LIGHT FOR DISPENSING PORTIONS ONTO A TARGET AREA

(71) Applicants: James Aaron Staeben, Carlsborg, WA (US); Erin M. Staeben, Carlsborg, WA (US)

(72) Inventors: James Aaron Staeben, Carlsborg, WA (US); Erin M. Staeben, Carlsborg, WA (US)

(73) Assignee: FLIP-LIGHTS, LLC, Sequim, WA (US)

( * ) Notice: Subject to any disclaimer, the term of this patent is extended or adjusted under 35 U.S.C. 154(b) by 53 days.

(21) Appl. No.: 15/077,470

(22) Filed: Mar. 22, 2016

(65) Prior Publication Data

US 2016/0297583 A1 Oct. 13, 2016

Related U.S. Application Data

(60) Provisional application No. 62/144,200, filed on Apr. 7, 2015.

(51) Int. Cl.
*F21V 33/00* (2006.01)
*B65D 51/24* (2006.01)
(Continued)

(52) U.S. Cl.
CPC ..... *B65D 51/248* (2013.01); *B65D 47/0804* (2013.01); *B65D 47/2006* (2013.01);
(Continued)

(58) Field of Classification Search
CPC ..... F21V 33/00; F21S 8/00
(Continued)

(56) References Cited

U.S. PATENT DOCUMENTS 4,558,806 A 12/1985 Shabram
5,178,450 A 1/1993 Zelensky et al.
(Continued)

FOREIGN PATENT DOCUMENTS

CN 203173075 U 9/2013
GB 2507293 A 4/2014

OTHER PUBLICATIONS

Callanan, Solar powered bottle cap of US 20140071663 A1; product: http://www.thinkgeek.com/product/b4ad/.

*Primary Examiner* — Edwyn Labaze
(74) *Attorney, Agent, or Firm* — Jacques M. Dulin, Esq.; Innovation Law Group

(57) ABSTRACT

Universal fluid dispensing container cap assemblies having a closure in which is disposed an integrated externally pointing LED light, a battery power source, circuit with switch actuatable to automatically turn-ON the LED when the cap closure is actuated to open an aperture for portion dispensing. This permits one-handed dispensing in low light environments. The LED may be located in or on the cap lid, so that it is automatically oriented to point in the direction of dispensing and at the surface location on which the dispensing is directed, in order to illuminate the target area so that the contents are accurately disposed directly from the container in terms of target location and amount. In Pop-up cap embodiments, the LED may be positioned to shine through a clear cap wall or positioned on the cap exterior, pointing in the direction of the target area. White or colored LEDs may be used.

20 Claims, 8 Drawing Sheets

(51) Int. Cl.

| | |
|---|---|
| ***B65D 47/20*** | (2006.01) |
| ***B65D 47/08*** | (2006.01) |
| *F21V 23/04* | (2006.01) |
| *F21S 9/02* | (2006.01) |
| *F21Y 115/30* | (2016.01) |

(52) U.S. Cl.
CPC ..... *F21V 33/004* (2013.01); *F21S 9/02* (2013.01); *F21V 23/04* (2013.01); *F21Y 2115/30* (2016.08)

(58) Field of Classification Search
USPC ..... 362/96, 101, 149, 154
See application file for complete search history.

(56) References Cited

U.S. PATENT DOCUMENTS

| | | | | |
|---|---|---|---|---|
| 5,311,413 | A | 5/1994 | Farmer | |
| 6,341,720 | B1 | 1/2002 | Schmit | |
| 6,454,432 | B1 | 9/2002 | Avinger | |
| 7,040,776 | B2 | 5/2006 | Harrell et al. | |
| 7,740,368 | B2 | 6/2010 | Chiang | |
| 7,976,177 | B2 | 7/2011 | Dikopf | |
| 2004/0256487 | A1 | 12/2004 | Collins | |
| 2004/0262337 | A1* | 12/2004 | Young | B65D 47/0838 222/484 |
| 2005/0007773 | A1 | 1/2005 | Austin | |
| 2005/0047114 | A1* | 3/2005 | Harrell | B65D 51/248 362/101 |
| 2007/0084462 | A1 | 4/2007 | Allen | |
| 2007/0222619 | A1* | 9/2007 | Moran | G01F 1/075 340/573.1 |
| 2009/0175029 | A1* | 7/2009 | Chiang | B65D 51/248 362/101 |
| 2011/0188229 | A1* | 8/2011 | Rizo Hernandez | B65D 51/248 362/86 |
| 2011/0275989 | A1 | 11/2011 | Yedida | |
| 2012/0261379 | A1 | 10/2012 | Lenahan | |
| 2013/0176717 | A1 | 7/2013 | Harooni | |
| 2014/0071663 | A1 | 3/2014 | Callanan | |
| 2016/0015885 | A1* | 1/2016 | Pananen | A61M 5/142 604/111 |

* cited by examiner

TUBE/BOTTLE TOPS HAVING INTEGRATED CAP LIGHT FOR DISPENSING PORTIONS ONTO A TARGET AREA

CROSS-REFERENCE TO RELATED APPLICATION

This is the Regular U.S. Application corresponding to and claiming priority from U.S. Provisional Application Ser. No. 62/144,200 filed by the same inventors under the same title on Apr. 7, 2015, priority of which is claimed under 35 USC §§119, ff.

FIELD

This application relates to the portion dispensing field, and more particularly to universal apertured tube or bottle top assemblies having a flip, pop-up or twist-type closure in which is disposed an integrated LED light. The inventive tube/bottle top assemblies also include a battery power source and switch wherein the LED light is automatically turned-ON when the cap is actuated to open the aperture for portion dispensing. For a flip-lid, the LED light is located on the underside of the flip-lid, which upon opening is then automatically oriented to point both in the direction of dispensing of the bottle contents out of the bottle-top aperture and to point at the surface location on which the dispensing is directed, in order to illuminate the target area so that the contents are accurately disposed directly from the container in terms of target location and amount. In the pop-up and twist type cap assemblies, the LED is located on the exterior of the cap top, pointing in the direction of the target area. Actuating a movable cap member causes communication of a dispensing channel from the interior of the cap to the exterior and also closes a circuit contact to turn the LED light ON. In all these embodiments, closing the lid or the dispensing conduit, functions to turn OFF the LED.

BACKGROUND

There are a number of proposals for having lights incorporated in the lids or caps of containers, only a few of which have achieved commercial status. Most of the proposals have the lights pointing down into the container contents for a variety of purposes, primarily to illuminate the level of the contents in the container, for novelty, or for use of the contents to scatter light to the area on which the container is resting as a surrogate for a source of area lighting.

Examples are found in: U.S. 2011/0188229 A1 (Hernandez); U.S. Pat. No. 6,454,432 B1 (Avinger); and CN 203173075 U (Yu, 2013). Others, less pertinent, are: U.S. Pat. No. 5,311,413 A (Farmer); U.S. 2014/0071663 A1 (Callanan), see also http://www.thinkgeek.com/product/b4ad/; US 2005/0007773 A1 (Austin); U.S. Pat. No. 7,976,177 B2 (Dikopf); U.S. Pat. No. 7,740,368 B2 (Chiang); U.S. Pat. No. 7,040,776 B2 (Harrell); U.S. Pat. No. 5,178,450 A (Zelensky); and GB 2507293A (Ball, 2014).

U.S. 2014/0071663 is representative of the idea of incorporating LED lights in the lid pointing down to the container contents in order to scatter light. In its commercial embodiment, the lid includes a hanger, and the container is designed to hold potable water. See: http://www.tree-hugger.com/gadgets/self-filtering-water-bottle-also-acts-flashlight.html. When the LED lights are switched ON, the light directed into the water scatters. When the container is hung from a tent pole, the light is used to illuminate the tent. Of course, when the container is unscrewed from the lid, there is no scattered light effect, and that effect varies widely depending on the level of fluid in the container.

In many direct dispensing situations, particularly in low light or dark environments, it is important to dispense the contents of the container in a specified direction or area directly from the container without use of an intermediary tool, such as a brush or applicator wand (e.g., as in an iodine bottle). An example is dispensing liquor at bars, which normally have low ambient lighting. Another is dispensing oil or grease while doing repair work on a vehicle where overhead illumination is shielded by the hood of the vehicle. Still another example is dispensing glue while working on models. Other examples involve doing close work such as in electronics and the jewelry or watch-making trades. In those cases the worker or artisan's body shields the target area being worked-on from overhead illumination. Still another example is application of personal care products and medicaments, such as application of lubes, emollients, lotions or medications to targeted areas on the skin. In all these cases, proper illumination may be required which currently necessitates two-handed operation, one to hold a flash-light and the other to do the dispensing. However, in many cases one hand may be needed to do the dispensing and the other is otherwise occupied, such as by holding a tool, thereby not having a free hand available for also holding a light. Calling on another person is difficult, as the person working continuously has to direct the other person where to point the light, and more often the person holding the light cannot see the target area on which light is to be directed, or the worker or tool is in the way.

This need is well recognized, and the solution to date has been to provide a head-lamp or a light on the tool. Head lamps in many situations are unsuitable, require frequent adjustment as a result of aiming too high or low, interfere with head gear and may not give the target area good illumination. While lights integrated into tools are helpful, they clearly cannot be used in cases of dispensing applications.

Some cosmetics, such as lipstick, lip gloss, fingernail polish and teeth whitening gel are packaged in containers that use brushes for application. Lights have been incorporated in the brush-holder portion of the packaging to provide light at the tip of the brush when painting the cosmetic or polish. See, 2013/0176717. These applications do not involve direct dispensing from the container; rather they use an intermediary brush, wand or nozzle, and pose rather different problems.

Accordingly, there is a long felt and unmet need in the direct-from-the-container portion dispensing field for a solution to target area illumination during direct portion dispensing which frees a hand from holding a light while dispensing contents from a tube or bottle, is not interfered-with or occluded, is automatic ON/OFF, and is universally adapted to any type of direct portion dispensing container.

The Invention

SUMMARY

The invention is directed to universal tube or bottle top assemblies having actuatable closure lids in which is disposed an integrated LED light, which assemblies are adapted to cooperatingly engage direct-portion-dispensing containers.

In a first, flip-cap embodiment, the inventive tube/bottle cap assemblies comprise a two-part cap assembly, a lower portion that removably engages a portion dispensing container and which includes an aperture for dispensing product contents retained in the container. The second part of the cap assembly includes a flip-lid that is hinged to the lower portion, typically via a "butterfly-type" living hinge. The flip-lid typically includes a closure plug that is aligned with the dispensing opening in the lower section or portion of the cap assembly.

At least one LED light is disposed on the inner surface of the flip-lid so that it is hidden when the lid is closed. The LED(s) is/are located so as to not interfere with the aperture or the closure plug. The cap assembly also includes a battery power source and switch wherein the LED light is automatically turned-ON when the lid is flipped-open and OFF when closed. The LED light, being located on the underside of the flip-lid, upon opening of the lid is then automatically oriented to point light in the direction of dispensing of the bottle contents out of the bottle-cap aperture and to illuminate the surface location on which the dispensing is directed. The result is that the target area is clearly and adequately illuminated so that the contents are dispensed accurately in terms of target location and amount.

It should be understood that in alternative embodiments of the inventive assembly, the battery can be located in either the lower portion or the upper flip-lid portion of the cap assembly, or in the alternative one battery in each portion. In a first embodiment, the battery is located in a sealed section of the lower cap portion or section, and the wires leading to the LED in the flip-lid include a pressure contact switch that is in the NO state. That is, the switch elements are separated to insure the circuit is Normally Open, when the flip-lid is closed so that the light is OFF. Upon flipping the lid to the open position, pressure is released that holds the switch contacts apart, they spring back into contact with each other, closing the circuit to the ON condition, so that the battery energizes the LED, causing it to light up. In another embodiment, a contact may be embedded in the hinge of the flip-lid so that upon opening, the circuit goes Closed and the LED is activated ON. One skilled in this art will recognize that a wide range of suitable switch arrangements can be employed to effect the principles of the invention: that upon opening the flip-lid portion of the cap, the LED is energized to provide light.

In still another, alternative version of the flip-lid cap embodiment, the entire assembly of LED, battery and switch may be enclosed in the lower cap with the LED spaced from the dispensing aperture and pointing outward, that is, toward the direction of dispensing. The flip-lid portion may include a projection or plunger that presses on a portion of the upper surface of the lower cap so as to cause a leaf switch element to an NO state (OFF), preventing the LED from lighting when the lid is closed. Upon release of the lid, that is, opening it, the pressure is released, the circuit goes to the NC state (ON), and the LED lights up.

The lower portion of the flip-cap assembly may include threads for removably engaging a container. Thus, in accord with one aspect of this invention the cap assembly is universal, in that a set of standard cap sizes are produced to screw-onto matching standard containers. The invention thus includes the combination of the inventive cap assembly and a container to which it is threadedly mated, and into which any desired product may be retained. The inventive combination of cap light assembly and matching container may be provided, or individual cap assemblies having the inventive light system may be provided for after-market retrofit on tubes or bottles of product previously purchased by a user. Thus, for example, a homeowner, craftsman, artisan or tradesman may purchase a suite of the inventive cap assemblies of varying diameter for, or for retrofitting on product bottles already in his or her possession.

In second and third embodiments, the inventive target-illuminating cap light assembly of this invention is applied to both "pop-up" and "twist" type caps. A pop-up cap is one in which a top surface or lid assembly of the cap is pivotable on opposed edges (e.g., looking at the cap from above, the left and right edges include pivot members such as bosses). Pressing down on the movable top at a location 90° from the pivot (that is, seen from above, a back edge), causes that edge to depress, and the opposite edge to rise (that is, seen from above, a front edge), revealing a dispensing aperture. Typical commercial uses for pop-up caps are on shampoo bottles or body gels. These types of caps are ideal for one-handed operation. In this embodiment, the pop-up movable cap top includes an LED light facing outwardly and forwardly (toward the front edge). Depressing the back edge not only raises the opposed dispensing aperture, but it also closes the circuit to automatically power-ON the LED by a battery contained in the cap or lid assembly and illuminating the target area when the bottle is tilted to effect dispensing. The light being ON functions as a reminder to the user to close the cap by pressing on the edge adjacent the revealed dispensing aperture (front edge). After dispensing, closing the bottle by pressing on the front aperture edge automatically opens the circuit, turning off the light.

In one implementation of this embodiment, the pivoting lid assembly includes a lower recessed member (shallow cup) that contains the battery and circuit and an LED facing forward. This recessed member includes a vertical side wall, or dispensing direction portion of that side wall, that is made of transparent or translucent plastic. The LED, when ON is able to shine light through the plastic so as to illuminate the dispensing stream and the target area. The cup is closed by a lid member sealing the battery, circuit board and LED inside the hollow lid volume.

A third embodiment employs the inventive cap light assembly integrated into twist-type caps. Twist-type caps have an external dispensing aperture that is not covered by a closure. Rather, internal to the cap is a horizontal gate or valve assembly which, upon rotation of the cap with respect to the tube or bottle on which it is mounted, unblocks or blocks (depending on the direction of rotation) the dispensing channel from the interior of the cap to the external aperture. Typically a $1/16^{th}$ to $1/8^{th}$ rotational turn is all that is needed to open the valve to permit dispensing. Commercial uses include cosmetics, hair preparation and styling gels. As adapted with the inventive assembly, a twist-type cap includes an LED exposed on the exterior top of the cap. Rotation of the cap not only opens the conduit, but also closes the circuit to illuminate the LED by a battery included in the cap assembly. Counter-rotation turns off the light. The light being ON also functions in this embodiment as a reminder to close the container by rotating the cap.

While four principal embodiments are described herein, one skilled in this art will recognize that the principles of the invention may be applied in a straightforward engineering sense to a wide variety of cap types, functional operation and design, such that the invention is intended to cover such additional embodiments and adaptations. For example, it should be clear that various colors of LEDs may be used, for example red light in use environments where dark vision adaptation is to be preserved, such as photo labs. Where higher illumination levels are needed, and/or good color discrimination is required, such as in medical dispensing applications or tatooing, white LEDs may be used. Likewise, white LEDs may be used in bars for clarity in dispensing liquor. Different colors of LEDs may be used on an array of related liquids to be dispensed so that the user quickly learns to recognize that the wrong liquid is in hand because the light is not the correct color before dispensing, and the error caught.

BRIEF DESCRIPTION OF THE DRAWINGS

The invention is described in more detail with reference to the drawings, in which.

DETAILED DESCRIPTION OF THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. All publications, patents and applications cited in this specification are herein incorporated by reference as if each individual publication, patent or application had been expressly stated to be incorporated by reference.

Figure 1:
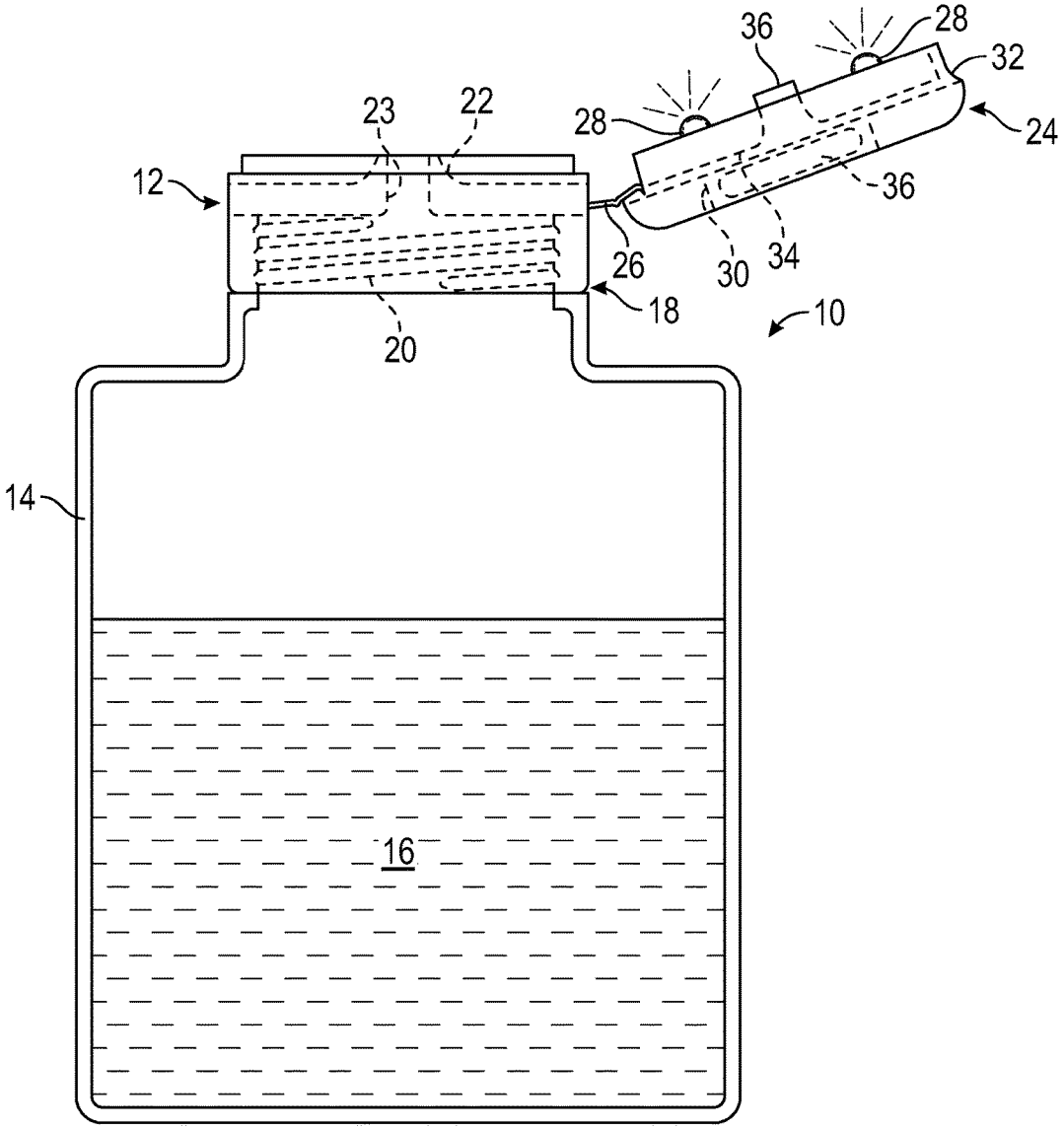
FIG. 1 is a side elevation view, partly in section, showing the inventive assembly of a dispensing container plus closure cap having at least one LED light positioned to illuminate a dispensing target area.

FIG. 1 illustrates a first embodiment of the inventive cap light and dispensing bottle assembly 10. The cap assembly 12 is retained on dispensing container 14 that retains fluid composition 16 to be dispensed by the user. The lower dispensing portion 18 of the cap includes inner threads 20 that engage the threaded neck of the container 14 and a spout or aperture 22 that has a bore or lip 23 through which the fluid contents 16 of the bottle may be dispensed when the container is inverted. The cap assembly 12 also includes an upper lid portion 24 that is connected to the lower threaded dispensing portion 18 via a hinge 26, in this example a living hinge of the butterfly type. The upper lid portion 24 includes at least one LED 28 and a battery compartment 30, containing battery 36 plus necessary circuitry (not shown) including an ON/OFF switch automatically activated by opening and closing the lid 24 portion. The LED(s) are positioned on the inside surface of the upper lid portion 24 of the cap so that when the lid is opened, the circuit is closed causing the LED(s) to light up. An important aspect of the invention is that when the lid portion 24 is in the open position as shown in FIG. 1, the LED(s) point at the target area for dispensing of fluid 16 so that the target area is illuminated. The LED(s) are not oriented to illuminate the contents 16 of the container 14, nor are they intended-to. Finger notch 32, assists in opening the lid section 24. Interior contour 34 of the lid may include a projection 36 that serves to close the dispensing bore 23 when the lid is in the closed position.

Figure 2:
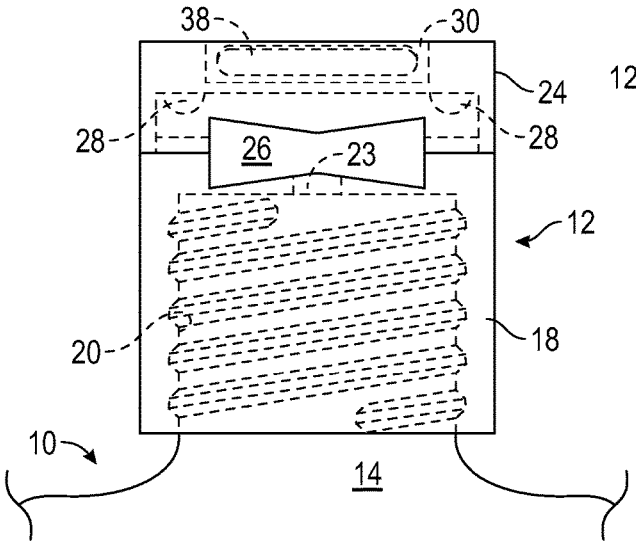
FIG. 2 is a side elevation view of the inventive lighted cap showing the hinge side and the upper lid portion fitting onto the lower threaded dispensing portion in the closed position.

FIG. 2 illustrates the cap assembly 12, from the position of the butterfly living hinge 26. The cap assembly lower dispensing portion 18 is threaded on the container 14. The upper lid 18 is closed on the lower portion 18, and shows the arrangement of the LEDs projecting from the inner surface of the lid 24, and having a centrally located battery compartment including a battery 36 with the appropriate circuitry including lid-actuated pressure switch (as described above) to power the LEDs.

Figure 3:
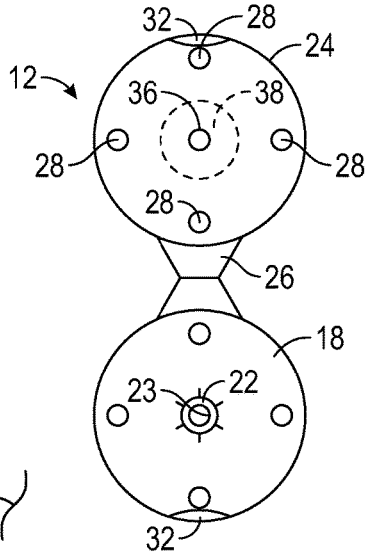
FIG. 3 is a top view of the inventive lighted cap in position of the lid portion open and showing an embodiment having four LED lights.

FIG. 3 illustrates the cap assembly 12 in the open position, top view. The LEDs in the lid portion 24 in this embodiment are positioned in an array around the central aperture plug 36, and the battery 38 is centrally located in its compartment in the lid. When the lid is opened, the LEDs are pointing in the same general direction as the pour spout 22, so that when the container is inverted and the bottle squeezed to dispense the bottle fluid contents, the light will be pointing at the target area for deposit of the dispensed fluid. It should be clear that while in this embodiment, four LEDs are shown, as few as one may be all that is necessary to provide suitable level of illumination, depending on the battery size and the efficiency of the LED element.

Figure 4A:
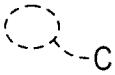
FIG. 4A is a schematic side elevation view of the inventive lighted cap showing a lid opened to a first position to illuminate a target area relatively close to the dispensing portion of the cap.
Figure 4A:
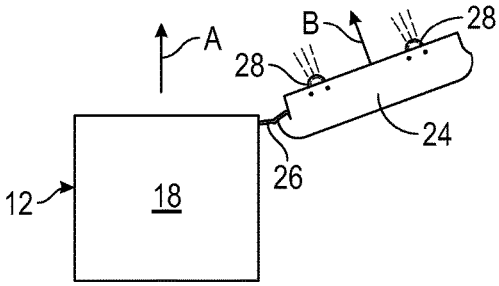
Figure 4B:
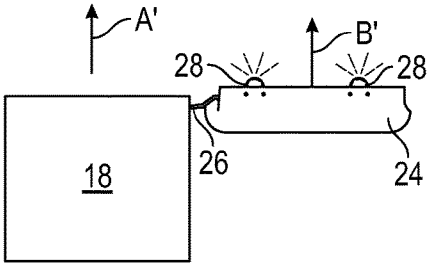
FIG. 4B is a schematic side elevation view of the inventive lighted cap of FIG. 4A showing the lid opened to a second position to illuminate a target area further away from the dispensing spout.

FIG. 4A and FIG. 4B show a two position lid version of the flip-lid embodiment of FIGS. 1-3. In FIG. 4A, the contents will be dispensed in the direction shown by Arrow A when the bottle is inverted. When the lid 24 is opened to a first position, FIG. 4A, the LEDs (in this embodiment, two are shown) will be pointing in a direction shown by the Arrow B. The arrows converge generally at the target area C. In FIG. 4B, the lid can be opened to a second position and the area of convergence is farther away.

Figure 5A:
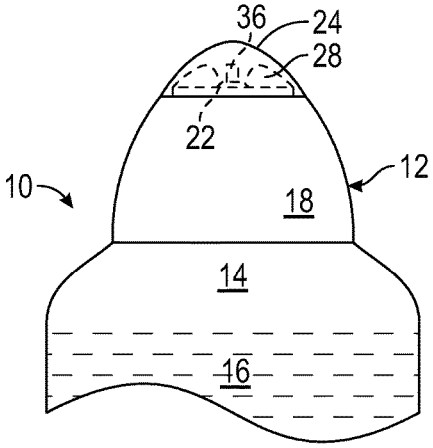
FIG. 5A is a front elevation view of a second embodiment of the inventive lighted cap assembly in which the cap is domed and the battery and LED light is disposed in either the lid or in the threaded portion of the cap; in this view, cap lid is closed.
Figure 5B:
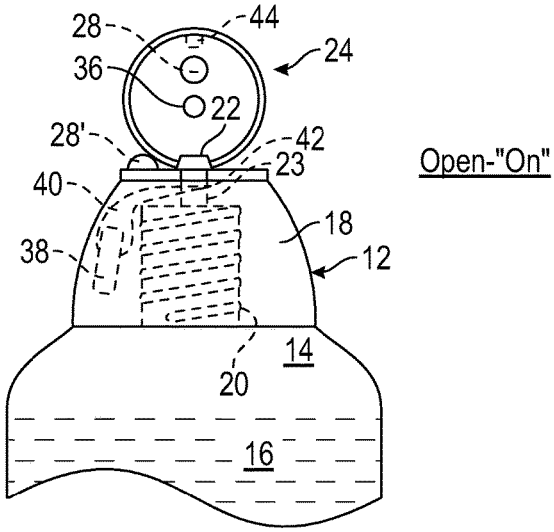
FIG. 5B is a front elevation view of the second embodiment shown in FIG. 5A in which the cap is partly open causing the LED to light up, and showing there may alternative locations for the LED.
Figure 5C:
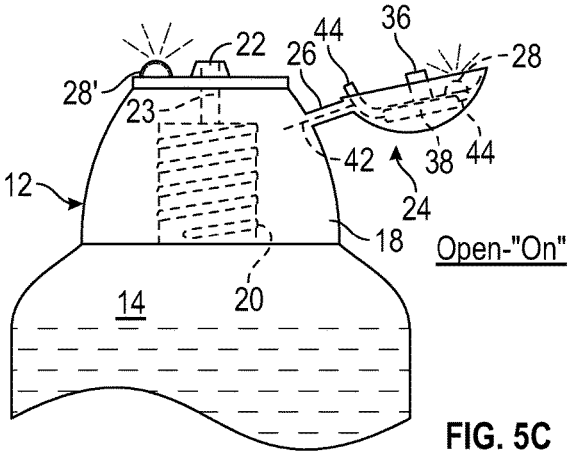
FIG. 5C is a side elevation of the second embodiment of FIGS. 5A and 5B, showing the cap in the fully open position, alternate positions for the LED, and a switch assembly associated with the lid hinge.

FIGS. 5A-C are to be considered together. They show a second embodiment of the inventive cap light assembly 10, in which the cap 12 is dome-shaped. The lid is hinged at the back side as before. FIG. 5B shows the battery located in the lower, threaded cap portion 18. The circuit 40 (shown schematically and in part as the drawing does not permit the detail that will be straight-forward to one skilled in this art) includes a switch assembly 42 disposed just below the upper, flexible surface of the cap, as shown. This switch 42 is activated from a NC state when the lid 24 is closed, to an NO state when the lid 24 is opened by means of a circuit breaker finger 44. As shown in FIG. 5B the finger is located on the forward edge of the lid, opposite the hinge (see FIG. 5C). In FIG. 5B the LED is shown in alternate positions, at 28 on the underside of the lid, and at 28' on the top surface of the lower dispensing portion of the cap. The dispensing spout 22 and its closure plug 36 are also illustrated. FIG. 5C illustrates the cap assembly of FIG. 5B in which the cap is now fully opened so that the LED, either in the lid at 28, or on the top surface of the lower portion at 28' is directed to the target area on which fluid 16 is dispensed from the container 14. Note in this alternative of this embodiment, the battery 38 is disposed in the domed lid, the switch 42 is located adjacent the hinge 26 in the lower portion 18, and the actuating circuit breaker finger 44 is located adjacent the hinge on the lid, as shown. For details of an exemplary switch assembly, see FIGS. 7A and 7B.

Figure 6A:
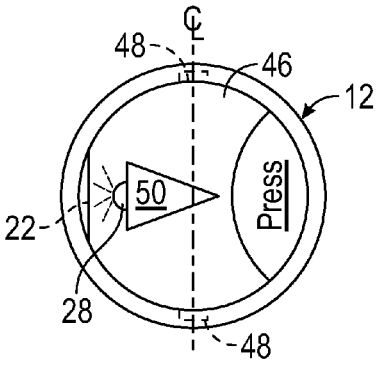
FIG. 6A is a top plan view of a third embodiment of the inventive cap light assembly, in which the cap is a "Pop-Up" type which has been fitted with an LED that illuminates the target area for a side-dispensing nozzle.
Figure 6B:
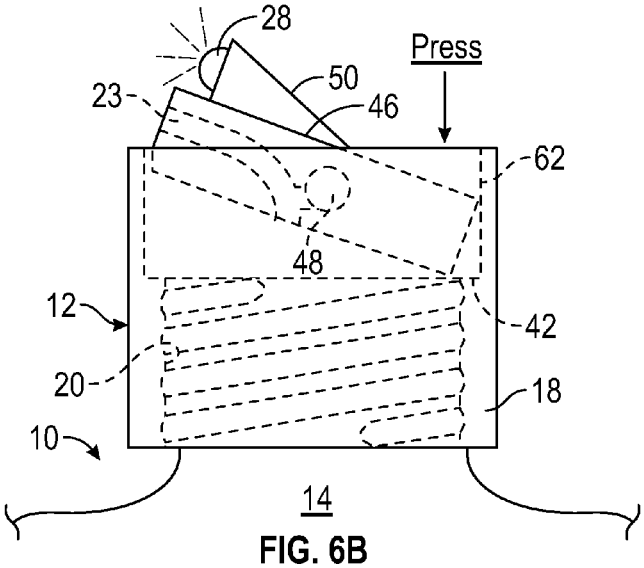
FIG. 6B is a side elevation view of the third, Pop-Up cap assembly of FIG. 6A, showing the piggy back arrangement of the LED.
Figure 6C:
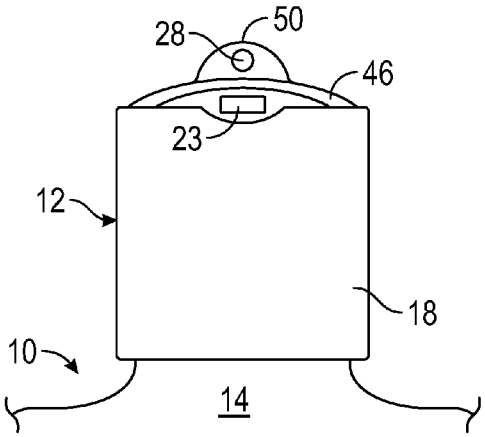
FIG. 6C is a front elevation view of the third, Pop-Up cap assembly of FIGS. 6A and 6B, showing the LED illuminating in the direction of dispensing by the pop-up nozzle bore.
Figure 6D:
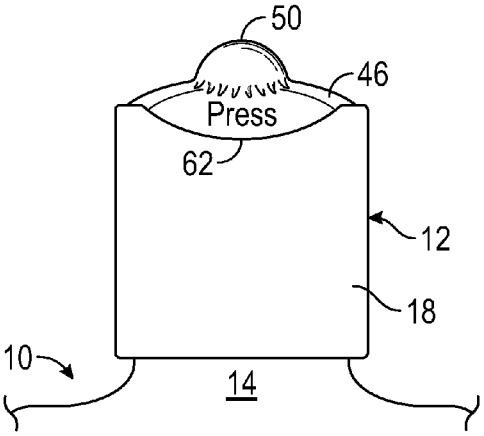
FIG. 6D is a rear elevation view of the third, Pop-Up cap assembly of FIGS. 6A-6C showing the recess in the lip of the lower cap to permit pressing down on one edge of the cap top pivoting disk to open the conduit for fluid dispensing and switch ON the LED(s)

The FIGS. 6A-D drawings are to be considered together. They show still another embodiment of the inventive cap light assembly, in this case adapted for use with a "Pop-Up" type dispensing cap assembly. In this embodiment the lid portion of the cap assembly 12 comprises a disk-shaped pop-up cap element 46 that is pivoted on diametrically opposed bosses 48 having a common center-line CL of pivot. Upon pressing down on an area of the disk 46 opposite the spout area 22, the bore 23 of the spout is raised permitting dispensing; this is best seen in FIGS. 6B and 6C. As shown in FIG. 6B, pressing down on the area marked "PRESS" (see FIGS. 6A, 6B and 6D) closes the switch 42, causing the LED to illuminate. The battery (not shown) may be located in any convenient place, such as in the disk 46 in the "PRESS" area, or vertically adjacent the threaded portion 20 of the lower portion of the cap 18. The LED 28 is disposed in a raised hood portion 50 of the disk element 46. FIGS. 6C and 6D clearly show that when the disk is pressed downwardly (FIG. 6B), the opposite end is raised above the lip of the lower cap portion 18 exposing the nozzle 23, and the LED 28 disposed in the hood is pointed in the same direction as dispensing, even though the dispensing is orthogonal to the bottle neck 20. Thus, the LED will illuminate the target area on which the fluid from bottle 14 will be dispensed. FIG. 6D shows a recess 62 in the outer wall of the cap lower portion 18 to facilitate pressing down on the disk element 46. The recess 62 permits pressing with the pad of the finger, that is, the finger can be oriented horizontally, to effect full depression of the disk 46 to insure activation of the switch 42 (FIG. 6B).

Figure 7A:
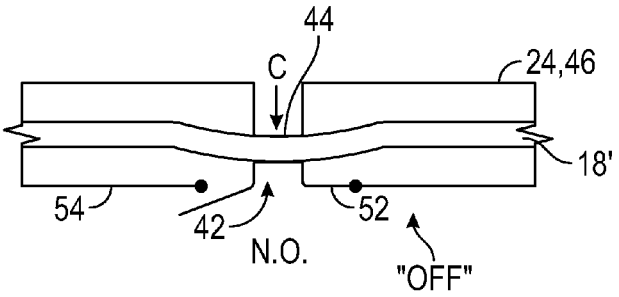
FIGS. 7A and 7B are enlarged schematics of an exemplary switch assembly using a circuit breaker finger or projection that is actuated upon opening and closing the cap lid member, FIG. 7A showing the switch in the Normally Open position when the cap lid is closed, and FIG. 7B showing the switch in the Normally Closed position when the cap lid is opened.
Figure 7B:
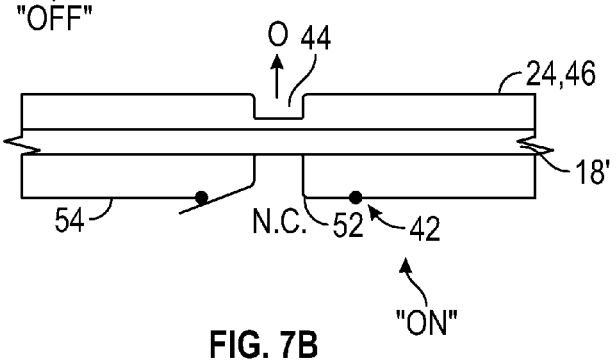

FIGS. 7A and 7B show one example of a switch that advantageously may be used in the lighted cap assembly of the invention. In FIG. 7A, the cap lid 24, 46 (depending on embodiment) is closed as indicated by Arrow C, in which case the circuit actuating finger 44 presses down on a flexible area 18' of the top of the lower portion 18 of the cap 12. The switch assembly in this exemplary embodiment includes a flexible or pivoted leaf 52 that is pushed out of contact with the opposite lead 54 by the action of finger 44, as shown, thus putting the switch in the Normally Open, NO, state, in which case the LED is dark. In FIG. 7B, when the lid 24, 46 is opened as indicated by Arrow O, pressure is removed from the area 18' and the leaf 52 springs up to contact the other lead 54, completing the circuit and energizing the LED to light up.

Figure 8A:
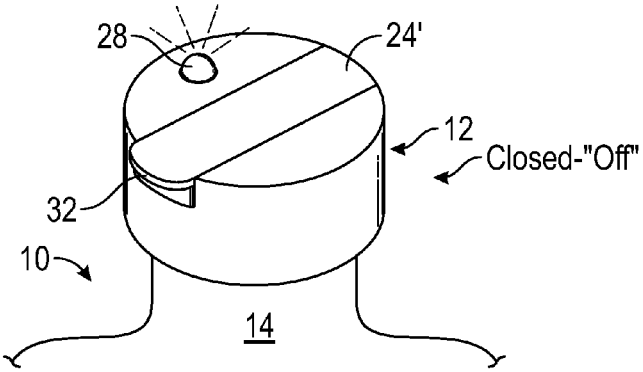
FIG. 8A is an isometric view of a fourth embodiment of the inventive cap light assembly in which the cap has a segmented or split, partial lid in the closed position and an LED disposed on the top outward-facing surface of the cap.
Figure 8B:
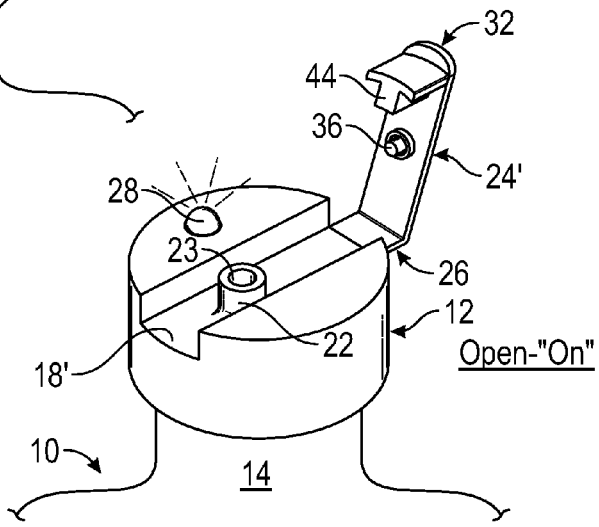
FIG. 8B is an isometric view of the fourth embodiment of FIG. 8A in which the segment of the cap is opened actuating the LED on the surface of the cap to illuminate the dispensing target area.

FIGS. 8A and 8B show another embodiment in which the cap assembly 12 includes an openable split or segmented lid portion 24'. In this embodiment, one or more LED(s) is/are disposed adjacent the central openable segment 24' on the outer top surface of the cap, as at 28. The segment 24' may be opened by engaging a lip or fingernail notch 32. In FIG. 8B the segment has been opened at hinge 26 and the LED lights up as the pressure from finger 44 has been relieved from the surface 18' (see FIGS. 7A and 7B above). The spout 22 is now exposed for dispensing via its bore 22 from the container 14. The LED 28 is directed to the target area and illuminates it for dispensing.

Figure 9A:
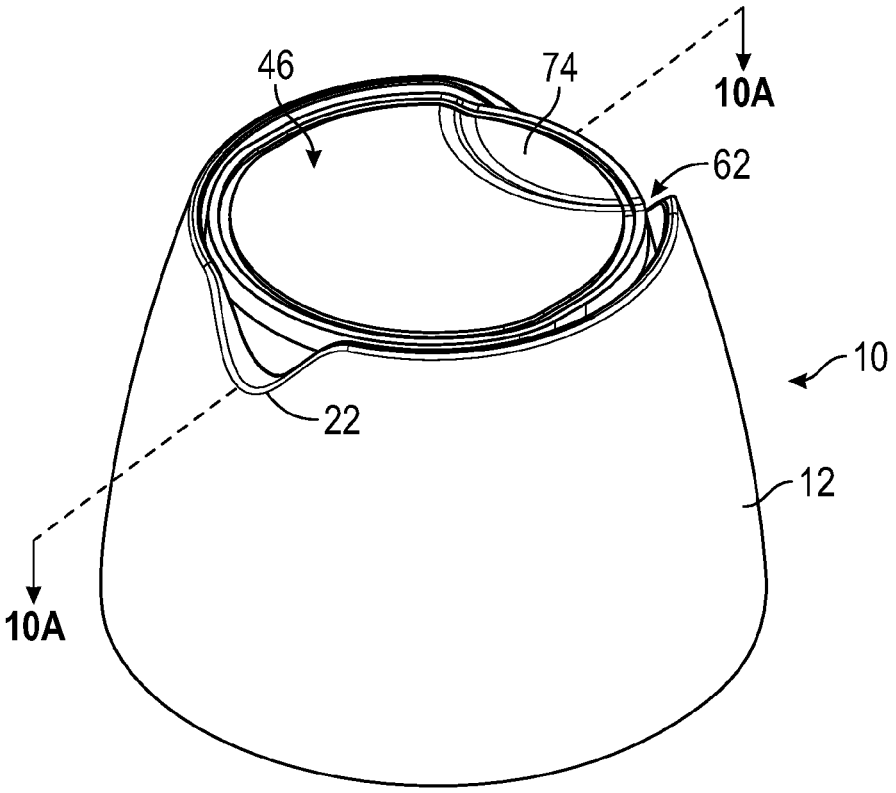
FIG. 9A is an isometric view of another implementation of the third embodiment, the Pop-up cap assembly, in the closed, or OFF position.
Figure 9B:
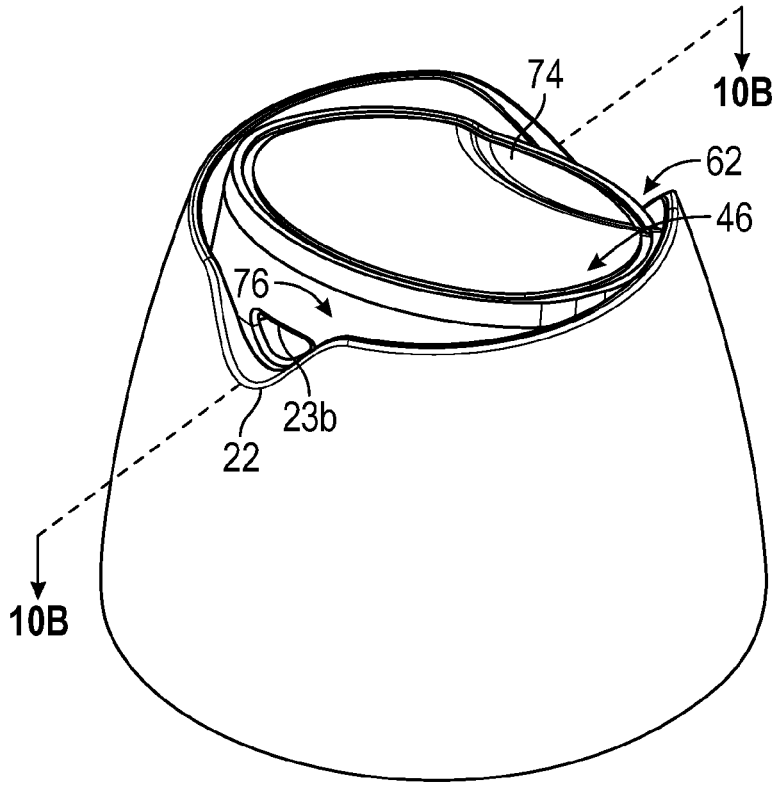
FIG. 9B is an isometric view of the implementation of the Pop-up cap embodiment in the open, or ON position.
Figure 10A:
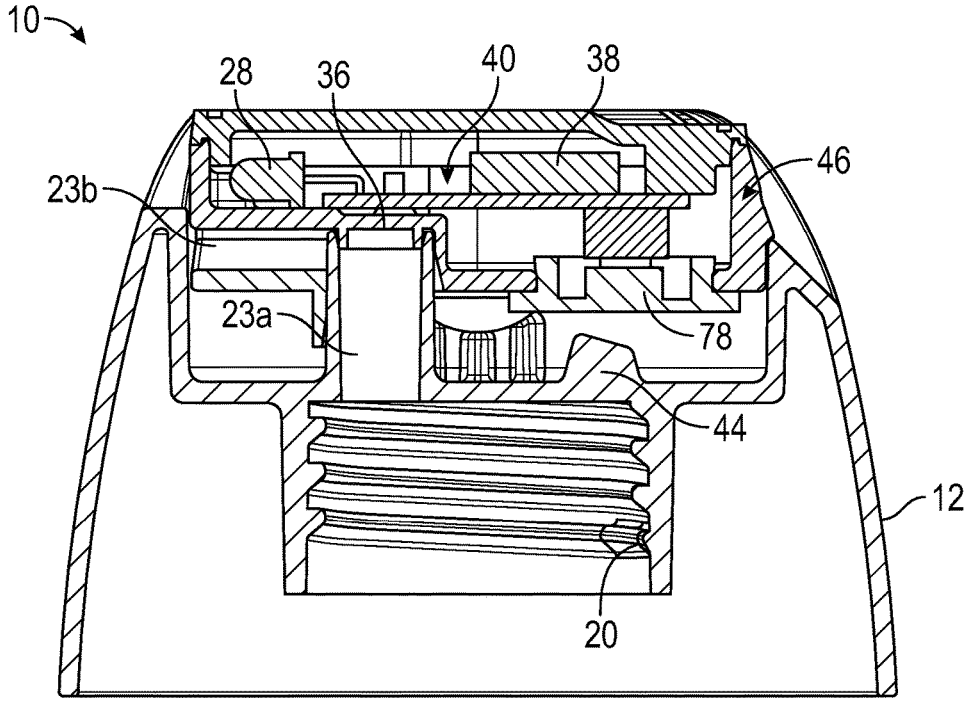
FIG. 10A is a section view along the line 10A-10A of FIG. 9A showing the internal assembly in the closed position in which the bottle contents-dispensing conduit is closed.
Figure 10B:
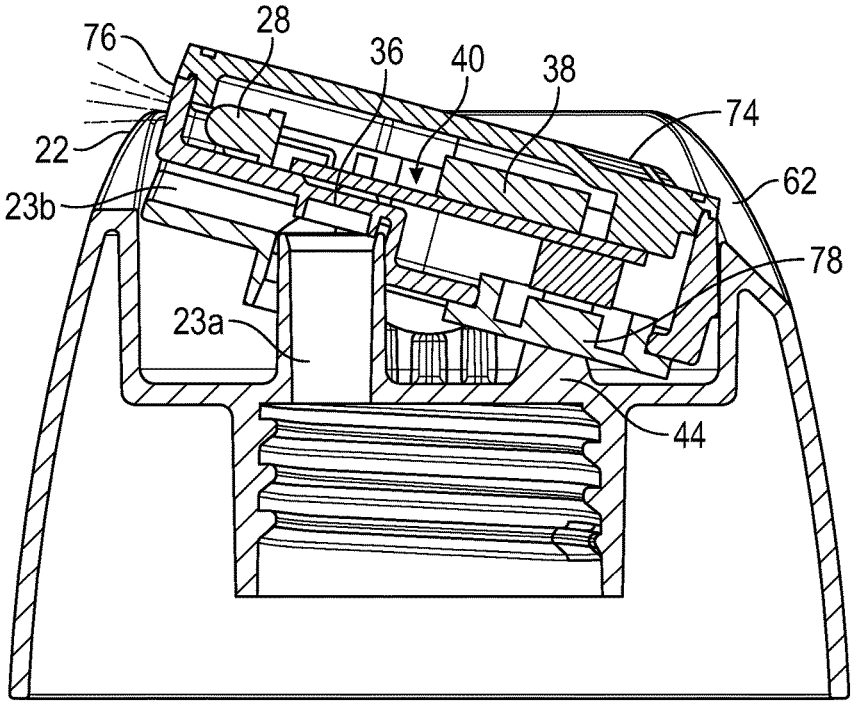
FIG. 10B is a section view along the line 10B-10B of FIG. 9B showing the internal assembly in the open, or ON position and the bottle contents-dispensing conduit is open.
Figure 11:
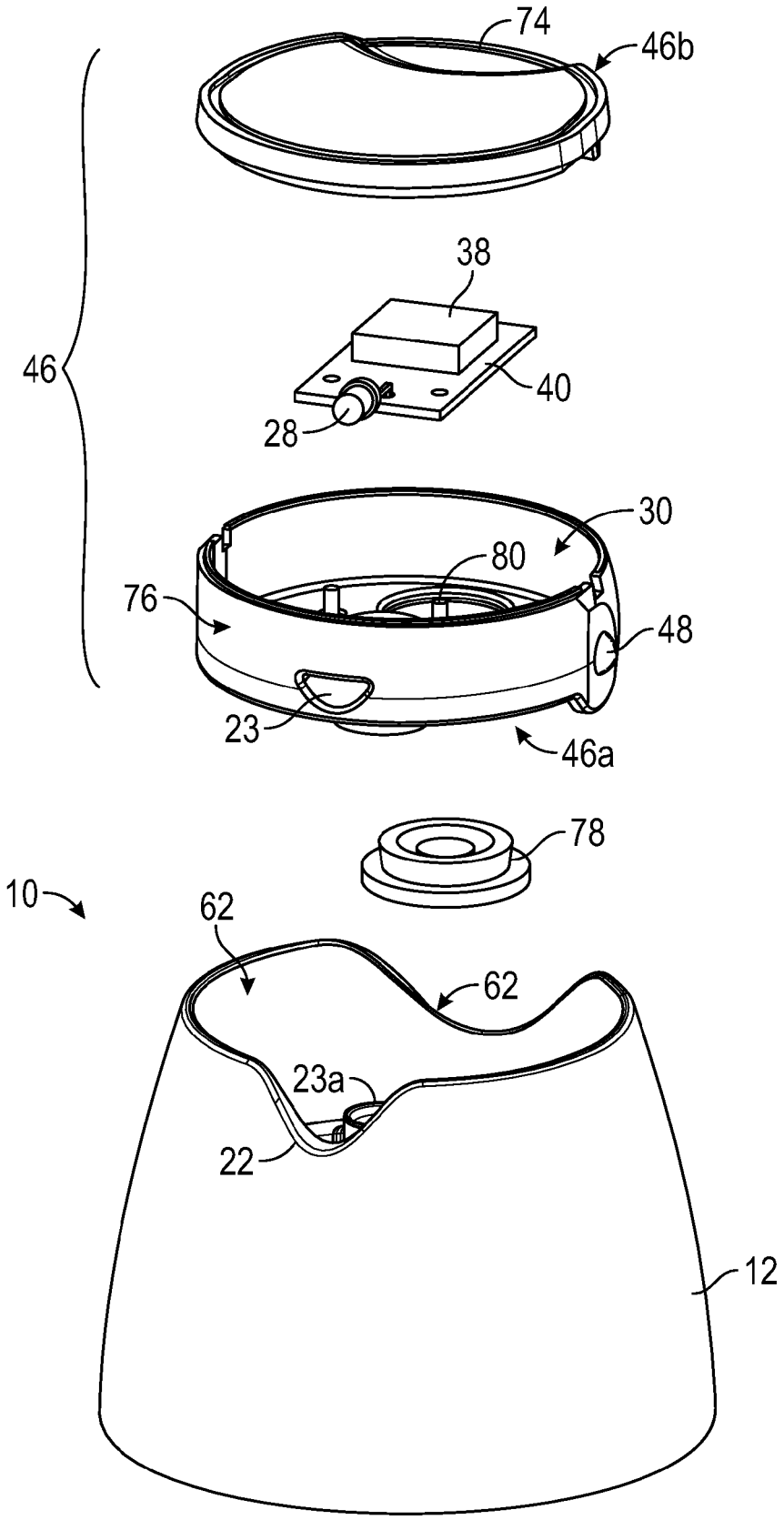
FIG. 11 is an exploded view of the implementation of the third, Pop-up embodiment of the inventive cap assembly shown in FIGS. 9A, 9B, 10A and 10B.

FIGS. 9-11 show another implementation of the third, Pop-up embodiment of the inventive cap assembly. FIG. 9A shows a Pop-up cap assembly 10 comprising bottle closure (cap) 12 in which the pivotable assembly 46 is housed. As shown, the pivoting member is in the OFF (circuit NO), closed position so that no contents of a bottle (not shown, but see FIG. 6B) can be dispensed via lip 22. In FIG. 9B the finger press area 74 of the back of the pivoting assembly 46 is depressed downwardly (see FIG. 6B) and the assembly 46 pivots down, exposing the conduit **23*b* that communicates with the interior of the bottle in order to permit dispensing of contents via the lip 22. This is the ON position (circuit NC) so that the LED, positioned inside the assembly 46 shines light through the clear side wall area 76**, thus illuminating both the contents dispensing and the target area.

FIGS. 10A and 10B show the internals of the cap assembly 10, showing the bottle threads 20, the dispensing tube 23*a* communicating from the inside of the bottle (not shown, see FIG. 6B) yet not aligned with external dispensing conduit 23*b* and closed-off by plug 36. As seen in FIG. 10A, the pivotable assembly 46 comprises a lower, cup member 46*a* (best seen in FIG. 11) which contains the LED 28, battery 38 and circuit board 40. A switch actuator 44 is spaced from a flexible diaphragm (gasket) so that the circuit board switch is open, and the LED 28 is OFF. In FIG. 10B, finger pressure on area 74 presses the back of the assembly 46 down, raising the plug from off the top of the tube 23*a* and permitting connection to dispensing conduit 23*b*. This permits dispensing contents out of the container via the lip 22. At the same time projection 44 engages the diaphragm that pushes up to close the switch on the circuit board 40, causing the battery 38 to energize the LED 28. Since the side wall of the cup 46*a* is transparent or translucent, the LED light shines on both the contents as delivered out of the container and on the target area onto which the contents are dispensed.

FIG. 11 shows the several parts of the cap assembly 10 in an exploded view, including the lower cap base containing the threads (see FIGS. 10A and 10B) and the vertical tube 23*a*. This view also shows the notch 62 at the back of the cap which permits pressing down on the lid 46*b* at area 74 to pivot the assembly 46. The front lip 22 is also shown. The pivoting Pop-up assembly 46 comprises lower cup 46*a*, which includes a recess volume 30 formed by an upstanding perimeter wall, at least the front portion of which 76 is transparent or translucent. The circuit board assembly 40, containing the battery, circuit, ON-OFF switch and LED is received in the recess 30, and the top closed by a generally planar lid 46*b* which may be ultrasonically sealed to the inner surface of the upstanding side wall adjacent the top. That is the circuit board assembly 40, including battery and LED are sealed in the pivoting Pop-up assembly 46, preventing leakage of fluid contents into contact with the circuit assembly 40 and shorting it out. The bottom surface of the cup 46*a* includes an aperture 80 that is sealed with the flexible diaphragm 78. Diaphragm 78 includes a central knob as shown to engage the switch on the circuit board 40 when actuated by the actuator 44 (compare FIGS. 10A and 10B). The diaphragm 78 also serves as a gasket to seal the aperture 80. Thus the entire Pop-up assembly 46 is sealed.

INDUSTRIAL APPLICABILITY

It is clear that the inventive cap light assembly of this application has wide applicability to the fluid dispensing industry, usefully so in the medical, personal care and personal hygiene fields. The inventive cap assembly provides additional functionality to a dispensing bottle, permitting one-handed use for targeted application of dispensed fluids in low light environments. Thus, the inventive lighted cap assembly has the clear potential of becoming adopted as the new standard for hand dispensed fluid container systems.

It should be understood that various modifications within the scope of this invention can be made by one of ordinary skill in the art without departing from the spirit thereof and without undue experimentation. For example, the caps can have a wide range of designs to provide the functionalities disclosed herein. Likewise, the batteries and LEDs may be located in any suitable portion of the assembly, whether in the lower threaded portion of the cap or the lid. This invention is therefore to be defined by the scope of the appended claims as broadly as the prior art will permit, and in view of the specification if need be, including a full range of current and future equivalents thereof.

Parts List (This Parts List is provided as an aid to Examination and may be canceled upon allowance)

| | |
|---|---|
| 10 Inventive illuminated cap and bottle assembly | 82 |
| 12 Cap assembly | 84 |
| 14 Container (bottle or tube) | 86 |
| 16 Liquid contents of container | 88 |
| 18 Lower threaded portion of cap | 90 |
| 20 Cap/container threads | 92 |
| 22 Dispensing spout or pour-type lip 23 Spout bore | 94 |
| 24 Upper lid portion of cap assembly | 96 |
| 26 Hinge, e.g. living hinge | 98 |
| 28 1 or more LED lights | 100 |
| 30 Battery compartment | 102 |
| 32 Finger notch | 104 |
| 34 Interior contour of lid | 106 |
| 36 Projection to plug bore 23 of spout 22 | 108 |
| 38 Battery(ies) | 110 |
| 40 Circuit | 112 |
| 42 Switch Assembly | 114 |
| 44 Circuit breaker finger (switch actuator) | 116 |
| 46 Pivotable Pop-Up assembly; 46a cup; 46b lid | 118 |
| 48 Pivots (bosses) | 120 |
| 50 Hood | 122 |
| 52 Leaf of switch | 124 |
| 54 Second contact of switch | 126 |
| 56 C/L Center line of pivots in Pop-Up Lid | 128 |
| 58 NO Normally Open | 130 |
| 60 NC Normally Closed | 132 |
| 62 Pop-up cap recess | 134 |
| Arrow C Closed Lid position | 136 |
| Arrow O Open Lid position | 138 |
| Arrow PRESS downward pressure on edge of disk | 140 |
| Arrow A, A': Direction of dispensing of fluid | 142 |
| Arrow B, B': Direction of illumination | 144 |
| 74 finger press area for Pop-up embodiment caps | 146 |
| 76 Clear wall (area) of cup 46a. | 148 |
| 78 flexible diaphragm member with central knob | 150 |
| 80 aperture in bottom of cup 46a for diaphragm 78 | 152 |

The invention claimed is:

1. An improved dispensing cap assembly for a liquid fluid-retaining container comprising in operative combination:

a. a cap body including threads adapted to engage a threaded neck of a liquid fluid-retaining container and having a conduit for passage of liquid fluid from said container through said cap to an exterior location without removal of said cap body from said container;

b. said cap body having a lid portion movable from a first, CLOSED position in which said cap body conduit is closed to prevent passage of said liquid fluid from said container to said exterior location, to a second, OPEN position to permit passage of said liquid fluid to said exterior location;

c. at least one visible light emitting LED light disposed in said cap assembly, said LED being oriented to point externally of said container to direct visible light toward a target area of said exterior location onto which target area said liquid fluid from said container is to be dispensed;

d. a circuit assembly disposed in said cap assembly including a battery and an ON-OFF switch, said circuit providing power to selectively illuminate said visible light emitting LED when switched to the ON position;

e. said circuit assembly switch is selectively activated by movement of said lid to automatically energize said visible light emitting LED to an ON state when said cap lid is moved to said second opened position, and to automatically de-energize said visible light emitting LED to an OFF state when said cap lid is moved to said first closed position, to permit in low light environments one-handed manual dispensing of liquid fluid from said container to said target area that is visibly illuminated by said visible light emitting LED in said ON state; and f. whereby said cap assembly is configured to provide one-touch OPEN and ON functionality such that said fluid can be dispensed onto said illuminated target area, and said visible light emitting LED turns ON automatically, as said visible light emitting LED continues without need for additional actuation of said cap assembly.

2. An improved dispensing cap assembly as in claim 1 wherein said LED is disposed on an inner surface of said cap lid so that when said lid is opened, said LED will be pointing at said target area and will turn ON to visibly illuminate said target area onto which said liquid fluid may be manually dispensed.

3. An improved dispensing cap assembly as in claim 1 wherein said LED is disposed on an outer surface of said cap and oriented to be pointing at said target area so that when said lid is opened, said LED will turn ON to visibly illuminate said target area onto which liquid fluid may be manually dispensed.

4. An improved dispensing cap assembly as in claim 1 wherein said lid movement is selected from at least one hinge or pivot member disposed to permit said lid to be moved from said first closed position to said second open position.

5. An improved dispensing cap assembly as in claim 4 wherein said lid is a pop-up pivoting type lid assembly configured so that when one edge of said lid assembly is depressed downwardly, the opposite edge of said lid assembly is raised to expose a dispensing opening for dispensing of liquid fluid from said container.

6. An improved dispensing cap assembly as in claim 5 wherein said LED is exposed on the exterior of said pop-up pivoting type lid assembly and disposed to project light in the direction of dispensing of liquid fluid from said lid assembly.

7. An improved dispensing cap assembly as in claim 5 wherein said pop-up pivoting type lid assembly comprises a pivoting sealed compartment in which said LED is disposed, a wall portion of said compartment is selected from a transparent and a translucent material, and said LED is oriented to provide light through said wall material to project light in the direction of manual dispensing of liquid fluid from said lid assembly when said lid assembly is pressed down to expose said dispensing opening.

8. An improved dispensing cap assembly as in claim 7 wherein said pivoting sealed compartment comprises a circular circumferential upstanding side wall defining a compartment volume, said side wall includes said portion selected from said transparent or translucent material through which said illumination from said LED may project, said cap body includes a recess for receiving said pop-up pivoting type lid assembly, said compartment wall includes a pair of projecting bosses disposed on opposite sides and defining there-between a pivot axis, said bosses are pivotably received in mating receivers in said cap body recess so that said lid assembly is movable down to an open position and up to a closed position, said lid assembly includes a conduit which when said lid assembly is in said open position is in communication with a tube disposed in said cap body to permit flow of liquid fluid retained in said container, said compartment volume includes said circuit assembly and said LED, and a planar lid engaging said side wall around said circumference, said lid being secured to said side wall around said circumference to form said compartment volume sealed against moisture intrusion.

9. An improved dispensing cap assembly as in claim 8 wherein said compartment includes a bottom wall, said bottom wall including an aperture plugged with a flexible diaphragm, said circuit assembly switch is actuated by an upstanding boss in said cap body aligned to engage said diaphragm when said lid assembly is in the down, open position to turn said switch to an ON state, thereby energizing said LED to illuminate in the direction of manual liquid fluid dispensing from said conduit.

10. An improved dispensing cap assembly as in claim 9 wherein said cap body includes a relieved portion disposed orthogonal to said pivot axis of said lid assembly wall bosses so that one edge of said lid assembly may be depressed down to the open, ON position.

11. An improved dispensing cap assembly as in claim 10 wherein said cap body includes a lip disposed adjacent said dispensing opening of said lid assembly.

12. An improved dispensing cap assembly as in claim 4 wherein said cap body includes a compartment for said circuit assembly.

13. An improved dispensing cap assembly as in claim 1 which includes multiple visible light emitting LED lights disposed to point toward said target area.

14. An improved dispensing cap assembly as in claim 1 wherein said cap includes a flip-type lid secured to said cap through a living hinge member.

15. An improved dispensing cap assembly as in claim 14 wherein said flip-type lid includes at least one LED light disposed on the interior of said lid and oriented so that when said lid is opened, said LED light is oriented to point toward and visibly illuminate said target area.

16. An improved dispensing cap assembly as in claim 15 wherein said flip-type lid includes a compartment for said circuit assembly.

17. An improved dispensing cap assembly as in claim 14 wherein said flip-type lid comprises only a segment of a top of said cap.

18. An improved dispensing cap assembly as in claim 17 wherein said LED is disposed on said top of said cap oriented to point toward and illuminate said target area when said flip-type lid segment is opened.

19. An improved dispensing cap assembly as in claim 1 wherein both said cap body and said lid include at least one LED disposed to point toward and visibly illuminate said target area.

20. An improved dispensing cap assembly as in claim 1 wherein said cap is selected from flip-lid, pop-up lid and twist-type caps.

* * * * *